US005936361A

United States Patent [19]

Yamashita et al.

[11] Patent Number: 5,936,361

[45] Date of Patent: Aug. 10, 1999

[54] DISCHARGE LAMP LIGHTING CIRCUIT WITH LIGHTING CONDITION DETECTOR

[75] Inventors: Masayasu Yamashita; Atsushi Toda, both of Shizuoka, Japan

[73] Assignee: Koito Manufacturing Co., Ltd., Tokyo, Japan

[21] Appl. No.: 09/006,881

[22] Filed: Jan. 14, 1998

[30] Foreign Application Priority Data

Jan. 14, 1997 [JP] Japan ..... 9-015962

[51] Int. Cl.[6] ..... G05F 1/00

[52] U.S. Cl. ..... 315/308; 315/224; 315/127; 315/83

[58] Field of Search ..... 315/308, 307, 315/224, 127, 291, 77, 83, 82, 209 R, DIG. 7; 307/10.8; 340/652, 687, 825.06

[56] References Cited

U.S. PATENT DOCUMENTS

| | | | |
|---|---|---|---|
| 4,348,613 | 9/1982 | Hormel et al. | 315/130 |
| 4,728,861 | 3/1988 | Kurihara et al. | 315/83 |
| 5,068,570 | 11/1991 | Oda et al. | 315/128 |
| 5,118,990 | 6/1992 | Makita | 315/77 |
| 5,140,229 | 8/1992 | Yagi et al. | 315/307 |
| 5,142,203 | 8/1992 | Oda et al. | 315/308 |
| 5,151,631 | 9/1992 | Oda et al. | 315/127 |
| 5,177,397 | 1/1993 | Nagasawa et al. | 313/318 |
| 5,212,428 | 5/1993 | Sasaki et al. | 315/308 |
| 5,278,452 | 1/1994 | Matsumoto et al. | 307/10.8 |
| 5,295,036 | 3/1994 | Yagi et al. | 361/79 |
| 5,422,548 | 6/1995 | Yamashita et al. | 315/308 |
| 5,438,480 | 8/1995 | Yamashita | 361/760 |
| 5,449,973 | 9/1995 | Yamashita et al. | 315/82 |
| 5,485,059 | 1/1996 | Yamashita et al. | 315/307 |
| 5,486,740 | 1/1996 | Yamashita et al. | 315/308 |
| 5,514,935 | 5/1996 | Oda et al. | 315/82 |
| 5,565,743 | 10/1996 | Yamashita et al. | 315/310 |
| 5,572,094 | 11/1996 | Yamashita et al. | 315/308 |
| 5,629,588 | 5/1997 | Oda et al. | 315/308 |
| 5,663,613 | 9/1997 | Yamashita et al. | 315/308 |

*Primary Examiner*—Haissa Philogene
*Attorney, Agent, or Firm*—Sughrue, Mion, Zinn, Macpeak & Seas, PLLC

[57] ABSTRACT

A discharge lamp lighting circuit which, when a discharge lamp is removed from a connecting member such as a socket or the like and the discharge lamp is judged unlighted, stops the power supply to the discharge lamp to thereby prevent ill effects caused by the wrong detection of connecting condition detect means used to detect a connecting condition between the discharge lamp and connecting member. The discharge lamp lighting circuit comprises lighting control which supplies an electric power to a discharge lamp through a given connecting member (such as a socket or the like) and controls the lighting of the discharge lamp, a lighting condition detector which is used to detect the lighted or unlighted condition of the discharge lamp, a connecting condition detector which detects whether the discharge lamp is connected to the connecting member or not, and a power supply control which controls the supply of power to the discharge lamp. When the power supply control receives from the connecting condition detector a signal indicating that the discharge lamp is removed from the connecting member and also receives from the lighting condition detector a signal indicating that the discharge lamp is in the unlighted condition, the power supply to the discharge lamp is stopped.

20 Claims, 5 Drawing Sheets

DISCHARGE LAMP LIGHTING CIRCUIT WITH LIGHTING CONDITION DETECTOR

FIELD OF THE INVENTION

The present invention relates to a discharge lamp lighting circuit which, when a discharge lamp happens to come off a connecting member, stops the supply of electric power to the discharge lamp to thereby protect the discharge lamp lighting circuit.

DESCRIPTION OF THE BACKGROUND ART

In a lighting circuit for a discharge lamp, there is often employed a protection circuit which cuts off the supply of electric power to the discharge lamp, when something wrong occurs in the discharge lamp or in the operation of the lighting circuit.

For example, the discharge lamp lighting circuit can be structured such that there is a detector for detecting the removal of the discharge lamp from a connecting member, such as a socket or the like, and, when such condition is detected, immediately stopping the supply of power to the discharge lamp.

However, in the above-structured lighting circuit, even if the discharge lamp is not removed from the connecting member, the detector may erroneously detect the removal of the discharge lamp due to vibrations, temporary poor contact or the like. As a result the power supply to the discharge lamp can be stopped or a blinking on and off of the discharge lamp can occur.

SUMMARY OF THE INVENTION

The present invention aims at eliminating the drawbacks found in the above-mentioned conventional discharge lamp lighting circuit. Accordingly, it is an object of the invention to provide a discharge lamp lighting circuit which accurately judges that a discharge lamp has come off its associated connecting member, such as a socket or the like, and also that the discharge lamp is in an unlighted condition, and stops the supply of power to the discharge lamp.

In attaining the above object, according to the invention, there is provided a discharge lamp lighting circuit which comprises lighting condition detector for detecting whether a discharge lamp is lighted or not, connecting condition detector for detecting whether the discharge lamp is connected to a connecting member or not, and power supply control for controlling the supply of power to the discharge lamp. More specifically, when the power supply control receives from the connecting condition detector a signal indicating that the discharge lamp is removed from the connecting member and also receives from the lighting condition detector a signal indicating that the discharge lamp is in an unlighted condition, the power supply control stops the supply of power to the discharge lamp.

Therefore, according to the invention, even when the connecting condition detector transmits to the power supply control a signal indicating that the discharge lamp is removed from the connecting member, unless the lighting condition detector detects that the discharge lamp is in the unlighted condition, the power supply to the discharge lamp is not stopped.

BRIEF DESCRIPTION OF THE DRAWINGS

FIG. 8 shows a state just after the supply of power supply to the lighting circuit is stopped when the discharge lamp is removed from its associated socket.

DESCRIPTION OF THE PREFERRED EMBODIMENT

Figure 1:
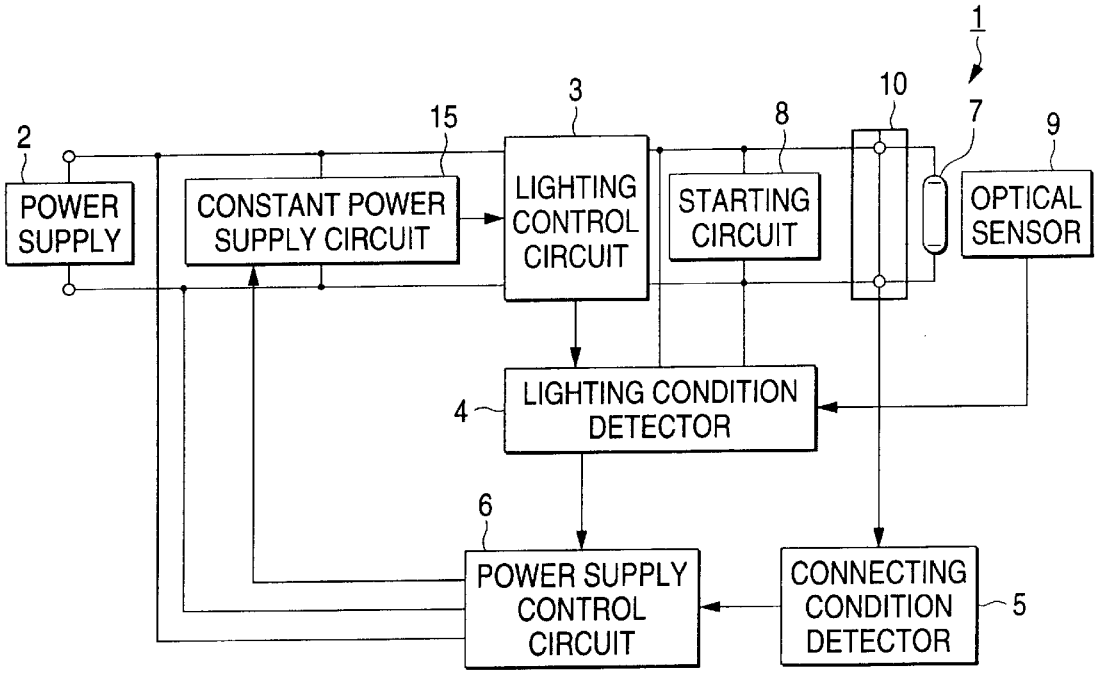
FIG. 1 is a block diagram of the basic structure of a discharge lamp lighting circuit according to the invention.

FIG. 1 shows a block diagram of the basic structure of a discharge lamp lighting circuit 1 according to the invention. In particular, the discharge lamp lighting circuit 1 comprises a power source 2, lighting control circuit 3, lighting condition detector 4, connecting condition detector 5, and power supply control 6.

The lighting control current 3 is used to control the electric power of a discharge lamp 7 (such as a metal halide lamp or the like) in accordance with a power supply voltage from the power supply 2. In the lighting control circuit 3, there is a conventional lighting circuit (such as a sine wave lighting system, a rectangular wave lighting system, or the like). As an example, the lighting control circuit 3 can supply electric power under two conditions, a first one where the power exceeds the rated electric power of the discharge lamp 7 in the early lighting stage of the discharge lamp 7 to thereby promote emission of light by the discharge lamp 7, and second where there is a stable constant supply of power to permit a steady lighting of the discharge lamp 7.

Also, the lighting control circuit 3 further includes in its output stage a starting device (a so-called "igniter") which, at the starting time of the discharge lamp 7, generates a start pulse and then supplies the start pulse to the discharge lamp 7. Such start pulse may be generated at a given time cycle (which is expressed as "Ttr") by the starting circuit 8 during a period of time until the discharge lamp 7 is started.

The lighting condition detector 4 is used to detect whether the discharge lamp 7 is in a lighted condition or in an unlighted condition. In particular, the lighting condition detector 4 may judge the lighted or unlighted condition of the discharge lamp 7 in accordance with the lamp voltage or lamp current of the discharge lamp 7. Preferably, the detection may detect a signal at an interior portion of the lighting control circuit 3 as a signal corresponding to the lamp voltage or lamp current (such as, when the lighting control circuit 3 includes a direct current boosting and reducing circuit, or a signal detected as the output voltage or output current of the direct current boosting and reducing circuit). Alternatively, the detection may be responsive to a signal detected by an optical sensor 9 which is disposed in the neighborhood of the discharge lamp 7. In either case, the lighting condition detector 4 must output the result of its activity to the power supply control circuit 6. Here, the term "unlighted condition" means that the discharge lamp is not lighted when it should be lighted; thus, the term "unlighted condition" does not include a case in which the discharge lamp is not lighted when it is not supposed to be lighted.

The connecting condition detector 5 is used to detect whether or not the discharge lamp 7 is connected to a connecting member 10, such as a socket, a connector or the like. In performing its detection function, the connecting condition detector 5 can use any one of various detecting methods. For example, as shown by an equivalent circuit in FIG. 2, in one method the opening or closing of detect contacts can indicate, whether or not the discharge lamp 7 is connected to the connecting member 10. To this end, in the interior portion of a socket 10A of the discharge lamp 7, there are provided not only power feed terminals 11, 11 (which are respectively to be connected to the power line of the lighting control circuit 3) for feeding electric power to the discharge lamp 7, but also a pair of detect contacts 12, 12. Also, as shown in the left part of FIG. 2, when the discharge lamp 7 is not connected to the socket 10A, the detect contacts 12, 12 are open (in FIG. 2, which is shown by a symbol expressing an off-state switch), whereas, as shown in the right part of FIG. 2, when the discharge lamp 7 is sufficiently connected to the socket 10A, the detect contacts 12, 12 are closed (in FIG. 2, which is shown by a symbol expressing an on-state switch). That is, in accordance with the binary value states that are shown by the detect contacts 12, 12, the connecting condition of the discharge lamp 7 to the socket 10A can be judged. Besides this method, there are other methods, for example, a method in which, when the discharge lamp is mounted onto the socket, part of the discharge lamp is detected optically or magnetically. In this second case, the above-mentioned detect contacts 12, 12 may be replaced with optical or magnetic sensors.

In any case, the detect result obtained by the connecting condition detector 5 is output to the power supply control circuit 6.

In operation, the power supply control circuit 6 stops the supply of power to the discharge lamp 7 when the two following conditions (I) and (II) are satisfied at the same time. However, the power supply control circuit 6 allows the power to be supplied to the discharge lamp 7 in other cases unless another stop condition (for example, when something wrong is detected in the discharge lamp or in the discharge lamp lighting circuit) is confirmed.

(I) The power supply control circuit 6 receives from the connecting condition detector 5 a signal indicating that the discharge lamp is removed from the connecting member; and, (II) The power supply control circuit 6 receives from the lighting condition detector 4 a signal indicating that the discharge lamp is in the unlighted condition.

As a result of the requirement for these two concurrent conditions, even if the fact that the discharge lamp 7 is not removed but there occurs an erroneous detection (such as a poor contact of the detect contacts 12, 12 or the like) by the connecting condition detector 5 due to vibrations or the like, the power supply control circuit 6 continues to supply power to the discharge lamp unless the unlighted condition of the discharge lamp 7 also is detected.

Figure 3:
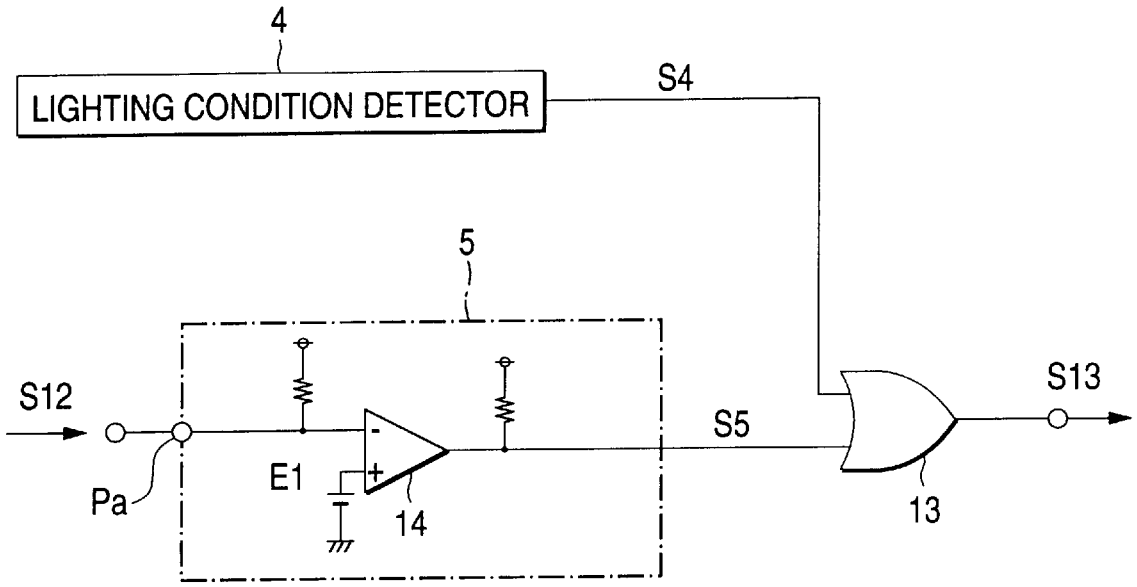
FIG. 3 is an explanatory view of a structure of power supply control current.

FIG. 3 is an explanatory view of the structure of the power supply control circuit 6, in which a detect signal (which is designated by S4) is output when the unlighted condition is detected. In the illustrated circuit, under those conditions an L (low) signal is output by the lighting condition detector 4 and is input to one input terminal of a two-input OR (logical sum) gate 13. Also, a signal corresponding to the opening and closing of the detect contacts 12, 12 (which signal is designated by S12) is input to the negative input terminal of a comparator 14. The level of the signal S12 is then compared with a reference voltage (which is designated by E1) that is supplied to the positive input terminal of the comparator 14. Thereafter, the signal S12 is input to the remaining input terminal of the OR gate 13 as a detect signal (which is designated by S5) of the connecting condition detector 5.

In such structure, when the detect contacts 12, 12 are open, the comparator 14 outputs an L signal. In particular, only when the detect signal S4 of the lighting condition detector 4 is an L signal, will the output signal (which is designated by S13) of the OR gate 13 be provided as an L signal. Under that condition, the power supply to the discharge lamp 7 is stopped by the L signal. Therefore, when at least one of the two input signals of the OR gate 13 is an H (high) signal, that is, when the discharge lamp 7 is in the lighted condition and/or when the detect contacts 12, 12 are closed, the output signal S13 of the OR gate 13 provides an H signal, so that the power supply to the discharge lamp 7 is permitted.

As a method for permitting or stopping a supply of power to the discharge lamp 7, for example, a switching device (such as a relay contact, a semiconductor switching element, or the like) may be provided on a power feed line from the power supply 2 to the lighting control circuit 3 and the switching device is controlled to turn on or off. In implementing this method, preferably, there is provided a constant power supply circuit 15 (see FIG. 1) which is used to generate a given constant power supply voltage from the power supply 2 and to supply this voltage to the lighting control circuit 3. Thus, the power supply to the discharge lamp 7 may be cut off by stopping the operation of the constant power supply circuit 15 or by cutting off the electric power output from the constant power supply circuit 15 to the lighting control circuit 3 in accordance with a control signal output from the power supply control circuit 6 to the constant power supply circuit 15. The reasons for this are that this method does not raise any problem relating to the contact capacity and pressure resistance of the switching device and also that the supply of power to the discharge lamp 7 can be controlled in a relatively simple manner without making the circuit configuration complicated or incurring a great increase in the cost of the discharge lamp lighting circuit.

Preferably, there may be provided signal masking circuit which is used to prevent a signal from being transmitted from the connecting condition detector 5 to the power supply control circuit 6, or to ignore this signal with respect to the power supply control circuit 6 during a predetermined period after the power supply to the lighting circuit 1 is initiated. This is because, when the wrong detection of the connecting condition detector 5 occurs during a period which extends from the time when the power supply of the lighting circuit 1 is put to work by operating a lighting switch or in accordance with an instruction signal from an automatic lighting device to the time when the discharge lamp 7 is turned on, the discharge lamp 7 is not yet lighted. This causes a condition under which the supply of power to the discharge lamp is prevented. For example, in a lighting device for a vehicle using a discharge lamp as a light source thereof, there is a concern that the wrong detection of the connecting condition detector 5 can be caused due to external disturbances such as the vibrations of the drive sources (such as an engine, motor and the like) of the vehicle, variations in the magnetic field thereof, and the like.

Figure 2:
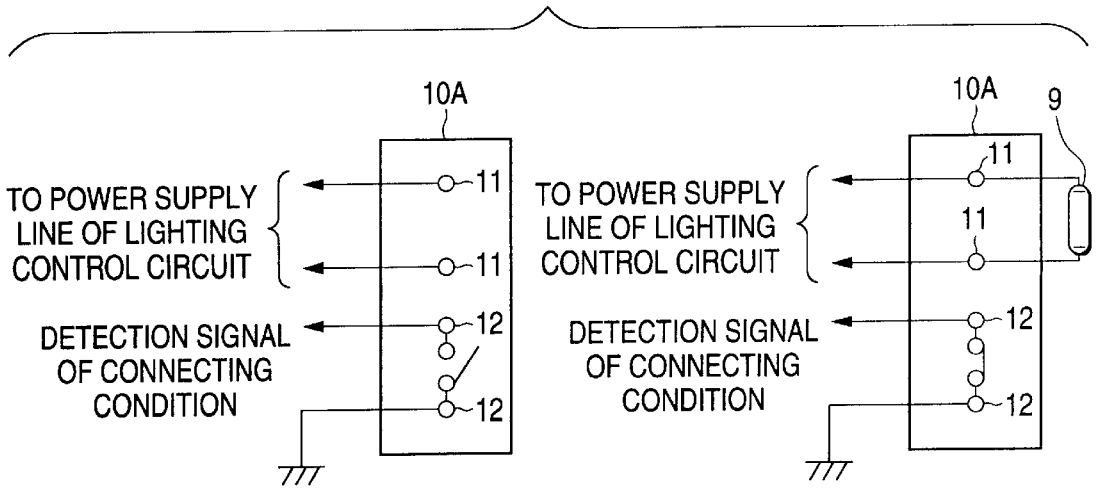
FIG. 2 is an explanatory view drawing the detection of a connecting condition between a discharge lamp and a connecting member.
Figure 4:
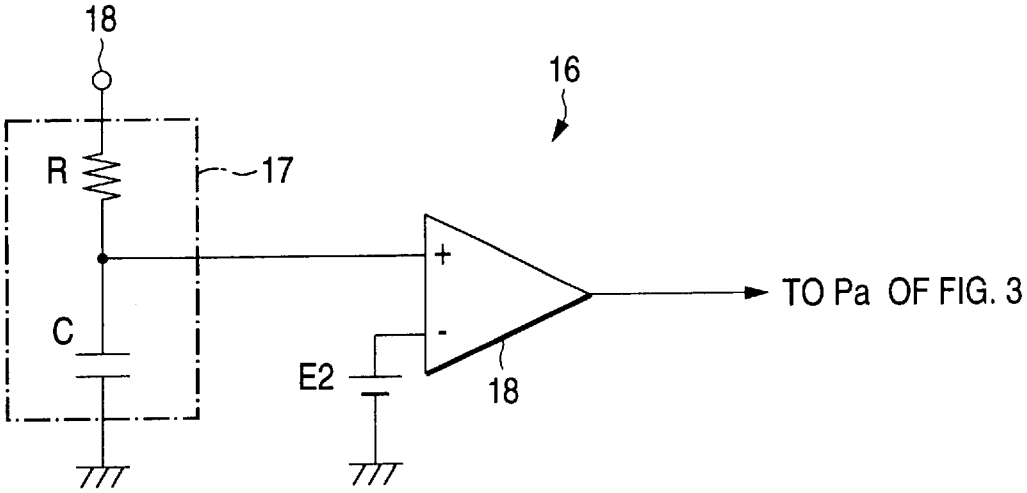
FIG. 4 is a circuit diagram of the structure of a signal masking circuit which, during a period predetermined after the initial supply of the power to the discharge lamp lighting circuit, masks a signal sent from a connecting condition detector to the power supply control.

To eliminate the above concern, in this case, for example, as shown in FIG. 4, the signal masking circuit 16 is composed of a time constant circuit 17 and a comparator 18. The time constant circuit 17 consists of a series circuit which is composed of a resistor R and a capacitor C, the one end of the resistor R being connected to a power source terminal 18 and the other end of the resistor R being grounded through the capacitor C. The terminal voltage of the capacitor C is input to the positive input terminal of the comparator 18 and a given reference voltage (which is expressed as E2) is supplied to the negative input terminal of the comparator 18, while the output terminal of the comparator 18 is connected to a connecting point Pa shown in FIG. 3 (that is, the output terminal of the comparator 18 is connected to the negative input terminal of the comparator 14). Consequently, the capacitor C is charged through the resistor R from the power source terminal 18 at the time when the power supply to the lighting circuit 1 is put to work. Thus, until the terminal voltage of the capacitor C exceeds a reference voltage E2, the output of the comparator 18 turns into and remains an L signal, so that the comparator 14 shown in FIG. 3 receives the same signal input as in a case when the detect contacts 12, 12 shown in FIG. 2 are closed. When the terminal voltage of the capacitor C exceeds a reference voltage E2, the output of the comparator 18 provides an open collector, so that the signal S12 indicating the open and closed conditions of the detect contacts 12, 12, as it is, provides a negative input signal to the comparator 14.

In the foregoing circuit, the judging time of the signal masking circuit 16 is regulated by the resistance value of the resistor R, the electrostatic capacity of the capacitor C, and the reference voltage E2, and the output of the signal masking circuit 16 is supplied to the comparator 14 provided in the input stage of the OR gate 13 shown in FIG. 3. Alternatively, as shown in FIG. 5, the circuit can also be structured such that it carries out an OR operation on the output signal of the signal masking circuit 19 and the output signal S13 of the OR gate 13.

Figure 5:
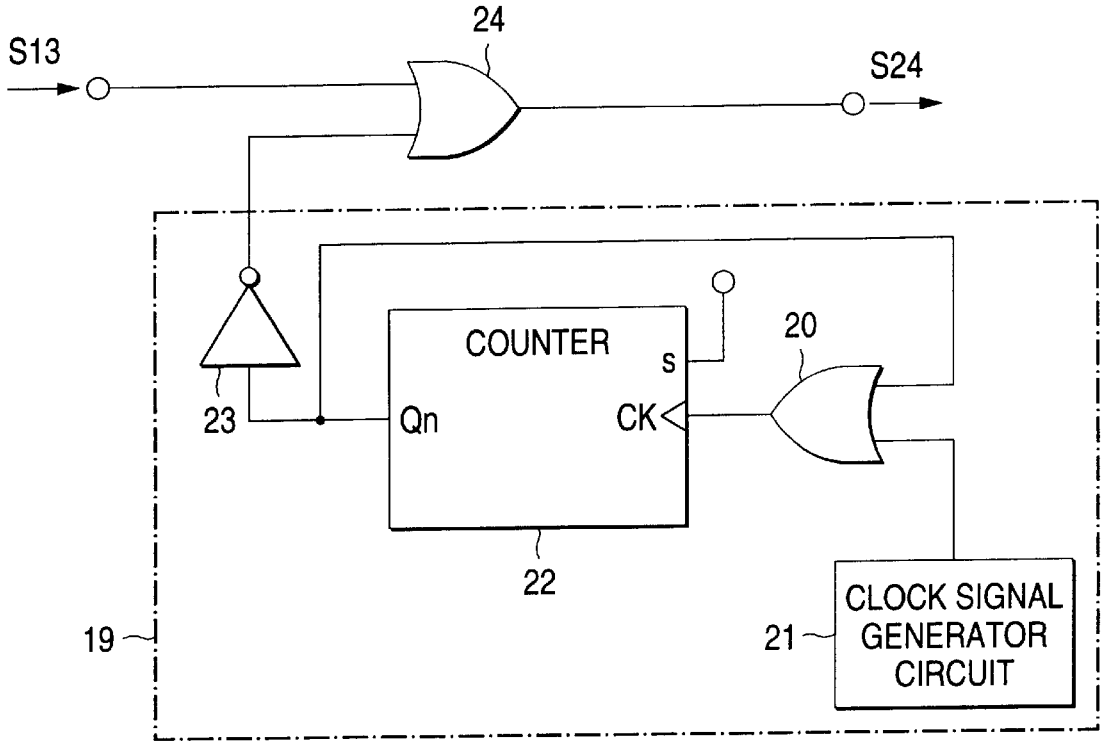
FIG. 5 is a circuit diagram of an alternative embodiment of the signal masking circuit shown in FIG. 4.

As shown in FIG. 5, a clock signal output from a clock signal generator circuit 21 is input to one input terminal of a two-input OR gate 20 and the output signal of the OR gate 20 is supplied to the clock input terminal (CK) of a counter 22. Further, the H signal is supplied to the set terminal (S) of the counter 22 after the power supply is put to work, while a bit signal in a given stage of the counter 22 is taken out from the output terminal (Qn) thereof and is sent to a NOT (inversion) gate 23 and, at the same time, the bit signal is also sent to the remaining input terminal of the OR gate 20.

The output signal of the NOT gate 23 and the output signal S13 of the OR gate 13 are input to the OR gate 24, where there is obtained an OR signal of the two output signals. With use of this structure, at and from the time when the power supply is put to work, the counter 22 counts the clock signals input through the OR gate 20. Also, during this operation, an H signal is sent from the output terminal (Qn) of the counter 22 through the NOT gate 23 to the OR gate 24, so that the OR gate 24 outputs an H signal.

Consequently, this is a supply of power to the discharge lamp 7. Further, when an H signal is output from the output terminal (Qn) of the counter 22 and this H signal is sent as an L signal through the NOT gate 23 to the OR gate 24, then the output signal of the OR gate 20 is regulated by the output signal S13 of the OR gate 13. That is, if the signal S13 of the OR gate 13 is an L (H) signal, then the output signal (which is expressed as S24) of the OR gate becomes an L (H) signal, thereby stopping (permitting) the power supply to the discharge lamp 7.

A predetermined of period time, which is necessary from the time when the power supply control means 6 receives both of the signal indicating the removal of the discharge lamp 7 from the connecting member 10 and the signal indicating the unlighted condition of the discharge lamp 7 to the time when the power supply to the discharge lamp 7 is stopped, may be preferably set shorter than the generation cycle Ttr of the start pulse to be generated by the starting means 8 when the discharge lamp 7 is turned on.

That is, in the structure shown in FIG. 3, generally, there occurs a time lag from the detect time of the abovementioned two conditions (I) and (II) to the time when the OR gate 13 outputs the L signal. If the time lag is longer than the start pulse generation cycle Ttr, then there is a concern that there can occur an undesirable effect (such as an electric shock accident, an electromagnetic interference with an external device, and the like) due to supply of the start pulse to the discharge lamp. Therefore, as a condition to prevent this problem, where a time necessary to judge that the two conditions (I) and (II) are satisfied at the same time is expressed as Td, if a relationship Td<Ttr is employed, then the generation of the start pulse can be stopped.

Figure 6:
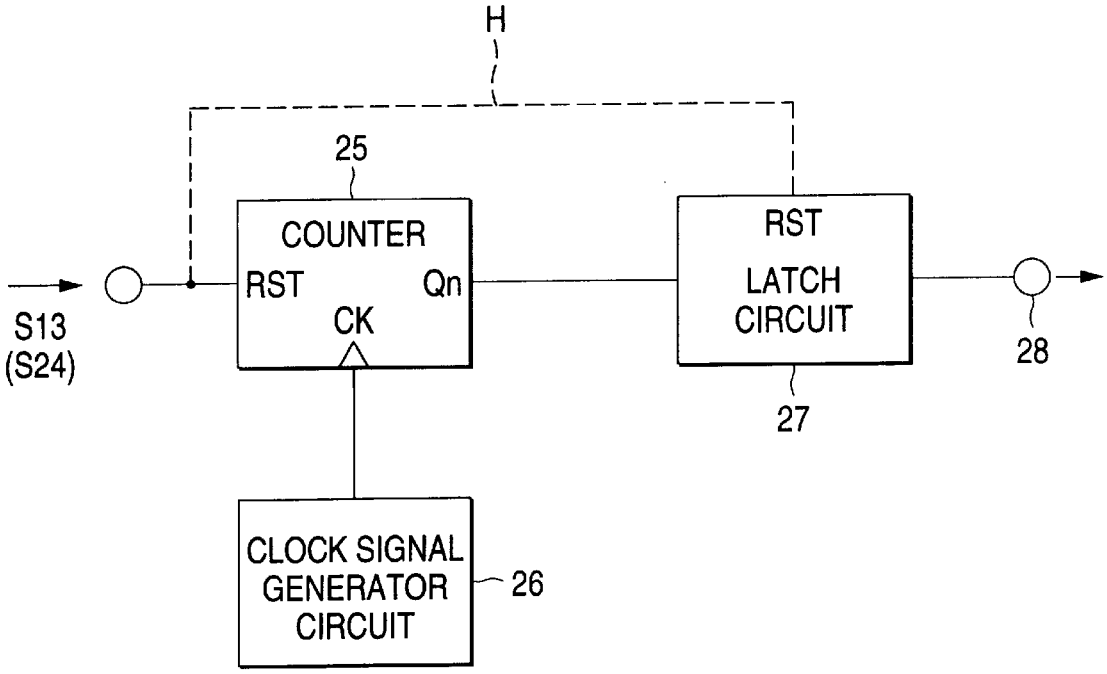
FIG. 6 is a circuit diagram to explain how to set a time necessary for judgment in stopping the power supply to the discharge lamp.

FIG. 6 is an example of a circuit configuration for this purpose, that is, with use of this circuit configuration, if the two conditions (I) and (II) are detected, then the power supply to the discharge lamp 7 is cut off and this cut-off state is held until the next power supply is put to work.

The signal S13 (or S24) is input to the reset terminal (RST) of a counter 25, while a clock signal from a clock signal generator circuit 26 is input to the clock input terminal (CK) of the counter 25. When the signal S13 (or 24) is an L signal, the counting operation of the counter 25 is carried out, and a bit signal in a given stage of the counter 25 is output through a latch circuit 27 from a terminal 28. Consequently, this circuit is regulated in the following manner: that is, the setting of the time Td is carried out by selecting the output stage of the counter 25 and the clock signals are counted by a given number, with the result that the time necessary for the output terminal (Qn) to turn into an H signal is set shorter than the pulse generation cycle Ttr. Due to this, during a period until the next start pulse is generated, the H signal to be output from the counter 25 is held by the latch circuit 27. Therefore, in this case, the latter part of the circuit may be configured in such a manner that the power supply to the discharge lamp 7 can be stopped at the time when the H signal is output from the terminal 28. That is, when the output of the terminal 28 turns into an H signal once, the terminal 28 is left in the state that it has output the H signal, unless the holding of the circuit 27 is removed by putting the power supply to work again.

A circuit can be configured such that the cut-off state of the power supply to the discharge lamp 7 is not held until the next power supply is put to work but, when either or neither of the conditions (I) or (II) is not satisfied, the power supply to the discharge lamp can be resumed, as shown by a broken line in FIG. 6. Specifically, if the signal S13 (or S24) is supplied to the reset terminal (RST) of the latch circuit 27, then the latch circuit 27 is reset when either of the condition (I) or (II) is not satisfied, thereby removing the holding of the H signal by the latch circuit 27.

FIGS. 7 to 11 respectively show an alternative embodiment of a discharge lamp lighting circuit according to the invention, which can be used as a lighting circuit for use in a lighting device for a vehicle employing a discharge lamp as a light source thereof.

Figure 7:
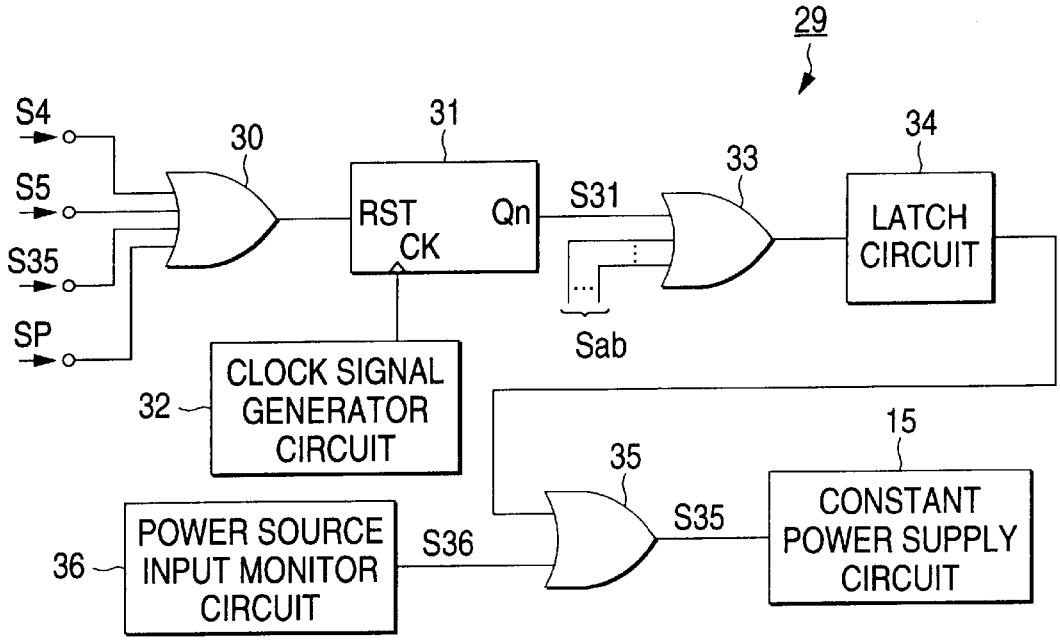
FIG. 7 shows an embodiment of a discharge lamp lighting circuit according to the invention, in particular, a circuit diagram of the main portions of the circuit configuration of the discharge lamp lighting circuit.

In particular, FIG. 7 is a block diagram of the main portions of a circuit configuration of a discharge lamp lighting circuit according to the present embodiment, which relates to the control of the power supplied to the discharge lamp. If the illustrated circuit is formed as an IC (integrated circuit) and is thereby united as a single chip, then the lighting device incorporating the circuit therein can be made compact in size.

In the circuit 29, after a lighting condition detect signal S4 (which provides an L signal when an unlighted condition is detected) is generated, several events occur. Specifically a connecting condition detect signal S5 (which provides an L signal when the removal of the discharge lamp 7 from the connecting member 10 is detected), an output signal of an OR gate 35 to be discussed later (which is expressed as S35 and provides an H signal when the power supply to the discharge lamp 7 is stopped), and a power-on reset signal (which is expressed as SP and provides an H signal only during a given period of time just after the power supply to the lighting circuit is put to work) are input to the respective input terminals of a multi-input OR gate 30. The output signal of the OR gate 30 is sent to the reset terminal (RST) of an output signal counter 31 (which corresponds to the above-mentioned counter 25). The counter 31, when the output signal of the OR gate 30 is an L signal, counts the number of clock signals sent from a clock signal generator circuit 32 and, after a given number of clock signals are counted, outputs an H signal from the output terminal (Qn) thereof to a multi-input OR gate 33 disposed downstream thereof.

Not only the output signal (which is expressed as S31) of the counter 31, but also a detect signal Sab (which provides an H signal when something wrong or an abnormal condition is detected), which is output from an abnormal condition detect circuit (not shown) used to detect an abnormal condition occurring in the discharge lamp or in the discharge lamp lighting circuit, are input to the input terminal of the OR gate 33. Consequently, if any one of the input signals to the OR gate 33 provides an H signal, then the present H signal is held by a latch circuit 34 disposed downstream of the OR gate 33 and, after that, the output signal of the latch circuit 34 is sent to one input terminal of a two-input OR gate 35 which is disposed further downstream of the latch circuit 34.

To the other input terminal of the OR gate 35, there is input a signal (which is expressed as S36 and provides an L signal when a power supply voltage or current is in an allowable range) from a power source input monitor circuit 36 which monitors whether or not the power supply voltage or current input to the lighting circuit is in a given range.

When the output signal S35 of the OR gate 35 is an H signal, the power supply to the discharge lamp 7 is stopped through the before-mentioned constant power supply circuit 15 and, as described above, the output signal S35 is input to the OR gate 30.

FIGS. 8 to 11 are respectively explanatory views of the operation of the above-mentioned circuit. In particular, in FIG. 8, reference character VB designates an input voltage to the lighting circuit 1, while Vcc stands for a power supply voltage which is supplied from the constant power supply circuit 15 to the above-mentioned respective circuit parts. The remaining illustrated signals are the same as mentioned above.

Figure 8:
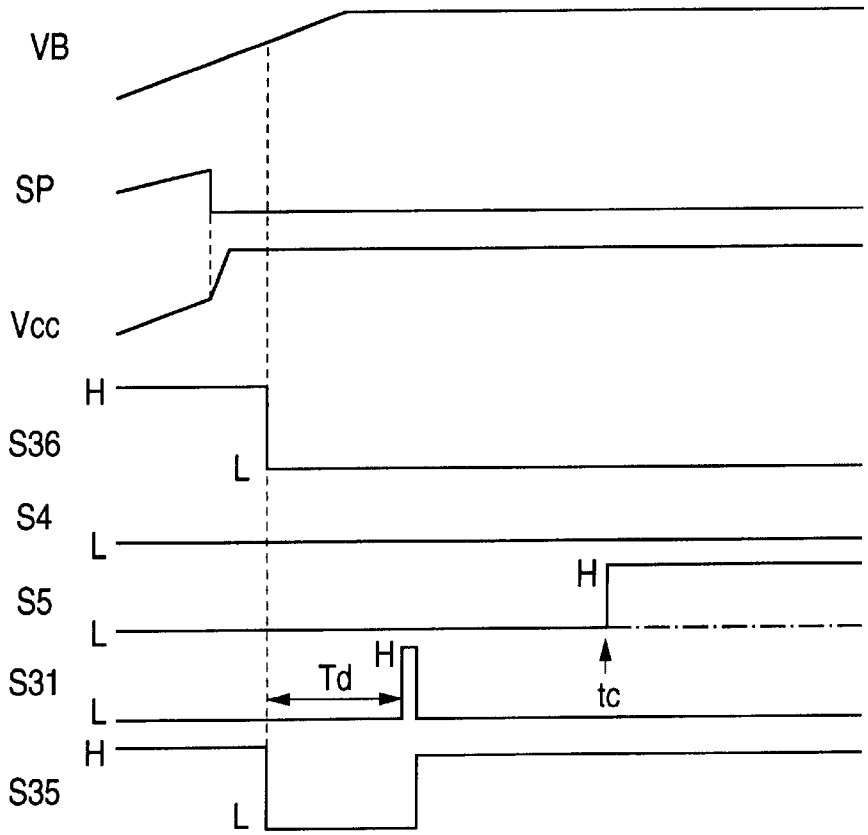
FIG. 8 is a set of waveforms and time charts to explain the operation of the circuit shown in FIG. 7 and, in particular.

Specifically, FIG. 8 shows a state just after the power supply to the lighting circuit is put to work while the discharge lamp is removed from the socket. That is, during a period of time starting at the power supply time, the power supply voltage Vcc rises gradually as the input voltage VB rises but, starting at the falling time of the power-on reset signal SP during the rising time of the input voltage VB, the power supply voltage Vcc rises sharply up to a regulated voltage value, so that the above-mentioned circuit with Vcc as the power supply voltage thereof is caused to operate.

Since the detect signal S36 is an H signal at first, the signal S35 is an H signal during at the same time, so that the power supply to the discharge lamp 7 is not executed. However, at the time when the input voltage VB exceeds a given value, the signal S36 turns into an L signal. Thus, at the falling time of the signal S35 which turns into an L signal last among the signals S4, S5 and SP, the counter 31 starts to operate and, after counting of a given number (which is expressed as a time Td), the signal S31 turns into an H signal temporarily.

In this case, although the power supply to the discharge lamp 7 is executed temporarily (see time Td), since the discharge lamp 7 is removed from the socket 10A and the discharge lamp 7 is judged as in the unlighted condition, due to latching of the signal S31 (H signal), the signal S35 turns into an H signal and the power supply to the discharge lamp 7 is thereby stopped. This state is held until the next power supply is put to work.

When the power supply voltage or current deviates from the allowable range, the signal S36 turns into an H signal to thereby stop the power supply to the discharge lamp 7. However, since the signal S35 turns into a reset signal through the OR gate 30, the output signal of the counter 31 is not latched and, therefore, when the signal S36 turns into an L signal, the power supply to the discharge lamp 7 is resumed. Also, when an H signal output by the OR gate 33 is latched, the signal S35 is turned through the OR gate 30 into a reset signal to the counter 31. However, because the signal S31 is already held by the latch circuit 34, there arises no problem in operation.

In FIG. 8, at a time tc, there is carried out an operation to connect the discharge lamp 7 to the socket 10A However, when the detect contacts 12, 12 of the socket 10A remain open due to poor contact or the like, as shown by a one-dot chained line in FIG. 8, tie signal S5 still remains an L signal.

Figure 9:
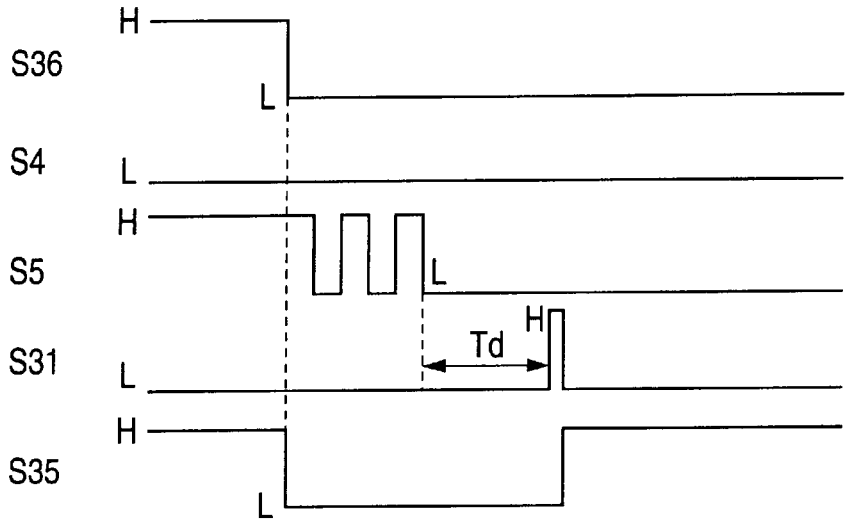
FIG. 9 is shows a state in which a signal S5 settles down into an L signal after the signal S5 is repeatedly inverted due to the wrong detection of connecting condition detector, after the power is supplied to the lighting.

FIG. 9 shows a state in which the signal S5 settles down to an L signal after it is repeatedly turned between an H signal and an L signal alternately due to the wrong detection by the connecting condition detect or 5 after the power supply to the lighting circuit is put to work.

In this case, at the time when the signal S5 finally turns from an H signal to an L signal, the counting operation of the counter 31 starts and, after passage of the time Td, the signal S31 turns into an H signal and the H signal S31 is held by the latch circuit 34, so that the signal S35 turns into an H signal to thereby stop the power supply to the discharge lamp 7, while this state is held until the next power supply is put to work.

Figure 10:
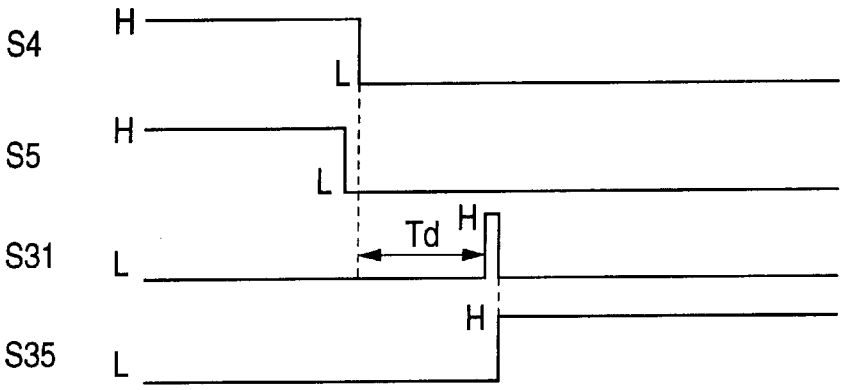
FIG. 10 shows a state in which the discharge lamp is removed from the socket while the discharge lamp is lighted.

FIG. 10 shows a state in which the discharge lamp 7 is removed from the socket 10A while the discharge lamp 7 is lighted. In particular, due to the fact that, while the signal S4 is an H signal, the signal S5 turns from an H signal to an L signal, the counting operation of the counter 31 starts at the falling time of the signal S4 and, after passage of the time Td, the signal S31 turns into an H signal temporarily and this H signal S31 is held by the latch circuit 34. Consequently, the signal S35 is turned into an H signal to thereby stop the power supply to the discharge lamp 7, while this state is kept on until the next power supply is put to work.

Figure 11:
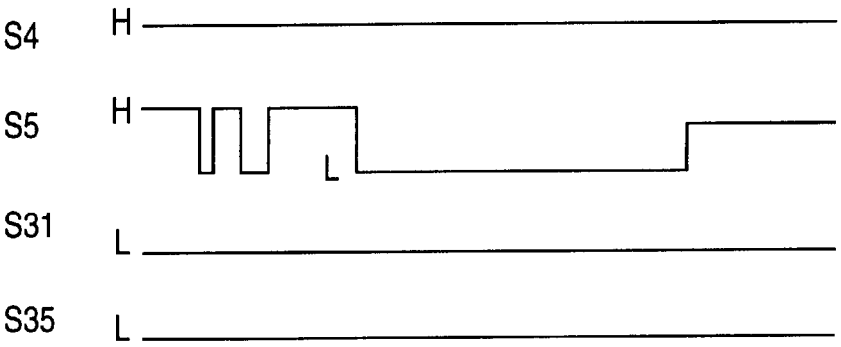
FIG. 11 shows a state in which the signal S5 settles down into an H signal after the signal S5 is repeatedly inverted due to the wrong detection of the connecting condition detector while the discharge lamp is lighted.

FIG. 11 shows a state in which the signal S5 settles down to an L signal after it is repeatedly turned between an H signal and an L signal alternately due to the wrong detection by the connecting condition detect or 5 while the discharge lamp 7 is lighted. In this case, because the signal S4 is an H signal, that is, because the discharge lamp 7 remains lighted, the signal S35 is an L signal, thereby allowing the power supply to the discharge lamp 7.

As can be seen clearly from the foregoing description, according to the invention, even when the connecting condition detector sends the power supply control a signal indicating that the discharge lamp is removed from the connecting member, the power supply to the discharge lamp is not stopped unless the lighting condition detector detects that the discharge lamp is in the unlighted condition. Therefore, even if any wrong detection occurs in the connecting condition detector, while the discharge lamp is lighted, the supply of power to the discharge lamp is executed. Thanks to this, it is possible to prevent sudden interruption of the supply of power to the discharge lamp or the repeated blinking of the discharge lamp due to a wrong detection of the connecting condition detector regardless of the lighting conditions of the discharge lamp.

Also, according to the invention during a period which passes by a given time from the supply of the power to the discharge lamp lighting circuit, the connecting condition detector is prevented from sending a signal to the power supply control means or such signal can be ignored, whereby there is eliminated an inconvenience that, when any wrong detection occurs in the connecting condition detector during the above period, the power supply to the discharge lamp can be stopped because the discharge lamp is not yet lighted.

Further, according to the invention a time necessary to stop the power supply to the discharge lamp is set shorter than the cycle of generation of a start pulse which is supplied to the discharge lamp when turning on the discharge lamp, thereby preventing occurrence of ill effects (such as an electric shock accident, electromagnetic interference and the like) caused by the fact that the start pulse is generated during the time necessary to stop the power supply to the discharge lamp.

What is claimed is:

1. A discharge lamp lighting circuit comprising:

lighting control means for supplying an electric power to a discharge lamp through a given connecting member and for controlling the lighting of the discharge lamp, lighting condition detect means for detecting the lighted or unlighted condition of the discharge lamp, connecting condition detect means for detecting whether the discharge lamp is connected to the connecting member or not, and power supply control means for controlling permission or stop of the power supply to the discharge lamp, wherein, when said power supply control means receives from said connecting condition detect means a signal indicating that said discharge lamp is removed from said connecting member and also receives from said lighting condition detect means a signal indicating the unlighted condition of said discharge lamp, the power supply to said discharge lamp is stopped.

2. A discharge lamp lighting circuit as set forth in claim 1, further including signal masking means for preventing said connecting condition detect means from sending a signal to said power supply control means or for ignoring said signal during a period passing by a given time after the power supply to said discharge lamp lighting circuit is put to work.

3. A discharge lamp lighting circuit as set forth in claim 1, wherein a time, which is necessary to stop the supply of power to the discharge lamp from the time when said power supply control means receives said signal indicating that said discharge lamp is removed from said connecting member and said signal indicating the unlighted condition of said discharge lamp, is set shorter than the cycle of generation of a start pulse which is supplied to said discharge lamp when turning on said discharge lamp.

4. A discharge lamp lighting circuit as set forth in claim 2, wherein a time, which is necessary to stop the power supply to the discharge lamp from the time when said power supply control means receives said signal indicating that said discharge lamp is removed from said connecting member and said signal indicating the unlighted condition of said discharge lamp, is set shorter than the cycle of generation of a start pulse which is supplied to said discharge lamp when turning on said discharge lamp.

5. A discharge lamp lighting circuit as set forth in claim 1, where in said lighting condition detect means comprises an optical detector.

6. A discharge lamp lighting circuit as set forth in claim 1, wherein said lighting condition detect means comprises a voltage detector.

7. A discharge lamp lighting circuit as set forth in claim 1, wherein said connecting condition detect means comprises an optical detector.

8. A discharge lamp lighting circuit as set forth in claim 1, wherein said connecting condition detect means comprises a contact detector.

9. A discharge lamp lighting circuit as set forth in claim 1, wherein said connecting condition detect means comprises a magnetic detector.

10. A discharge lamp lighting circuit as set forth in claim 1, further comprising a power source input monitor for monitoring whether the power supply output is within a predetermined range and said power supply control means is responsive to said monitor to supply power to said discharge lamp if said power supply output is within said range.

11. A discharge lamp lighting circuit for lighting a discharge lamp connected by a connecting member to a power supply, said circuit comprising:

a lighting control circuit connected to supply electric power from the power supply to the discharge lamp through the connecting member and to control the lighting of the discharge lamp, a lighting condition detector for detecting the lighted or unlighted condition of the discharge lamp, a connecting condition detector for detecting whether the discharge lamp is connected to the connecting member or not, and a power supply controller for controlling the supply of power to the discharge lamp, wherein, when said power supply controller receives from said connecting condition detector a signal indicating that said discharge lamp is removed from said connecting member and also receives from said lighting condition detector a signal indicating the unlighted condition of said discharge lamp, the power supply to said discharge lamp is stopped.

12. A discharge lamp lighting circuit as set forth in claim 11, further comprising signal masking circuit for preventing said connecting condition detector from sending a signal to said power supply controller or for ignoring said signal during a period after the supply of power to said discharge lamp lighting circuit is initiated.

13. A discharge lamp lighting circuit as set forth in claim 11, wherein a time, which is necessary to stop the supply of power to the discharge lamp from the time when said power supply controller receives both said signal indicating that said discharge lamp is removed from said connecting member and said signal indicating the unlighted condition of said discharge lamp, is set shorter than the cycle of generation of a start pulse which is supplied to said discharge lamp when turning on said discharge lamp.

14. A discharge lamp lighting circuit as set forth in claim 12, wherein a time, which is necessary to stop the supply of power to the discharge lamp from the time when said power supply controller receives both said signal indicating that said discharge lamp is removed from said connecting member and said signal indicating the unlighted condition of said discharge lamp, is set shorter than the cycle of generation of a start pulse which is supplied to said discharge lamp when turning on said discharge lamp.

15. A discharge lamp lighting circuit as set forth in claim 11, wherein said lighting condition detector comprises an optical detector.

16. A discharge lamp lighting circuit as set forth in claim 11, wherein said lighting condition detector comprises a voltage detector.

17. A discharge lamp lighting circuit as set forth in claim 11, wherein said connecting condition detector comprises an optical detector.

18. A discharge lamp lighting circuit as set forth in claim 11, wherein said connecting condition detector comprises a contact detector.

19. A discharge lamp lighting circuit as set forth in claim 11, wherein said connecting condition detector comprises a magnetic detector.

20. A discharge lamp lighting circuit as set forth in claim 11, further comprising a power source input monitor for monitoring whether the power supply output is within a predetermined range and said power supply controller is responsive to said monitor to supply power to said discharge lamp if said power supply output is within said range.

* * * * *